US007577396B2

(12) United States Patent
Kitano

(10) Patent No.: US 7,577,396 B2
(45) Date of Patent: Aug. 18, 2009

(54) PRINTING APPARATUS

(75) Inventor: Isao Kitano, Tokyo (JP)

(73) Assignee: Oki Data Corporation, Tokyo (JP)

( * ) Notice: Subject to any disclaimer, the term of this patent is extended or adjusted under 35 U.S.C. 154(b) by 323 days.

(21) Appl. No.: 11/505,399

(22) Filed: Aug. 17, 2006

(65) Prior Publication Data

US 2007/0071461 A1 Mar. 29, 2007

(30) Foreign Application Priority Data

Sep. 21, 2005 (JP) ..... 2005-273878

(51) Int. Cl.
*G03G 15/00* (2006.01)

(52) U.S. Cl. ..... 399/405; 399/389; 399/396; 271/265.02; 271/270

(58) Field of Classification Search ..... 399/405, 399/389, 396; 371/265.02, 270
See application file for complete search history.

(56) References Cited

U.S. PATENT DOCUMENTS 5,181,705 A * 1/1993 Ueda et al. ..... 271/3.15

FOREIGN PATENT DOCUMENTS

JP 2001-109217 4/2001

* cited by examiner

*Primary Examiner*—Judy Nguyen
*Assistant Examiner*—Andy L Pham
(74) *Attorney, Agent, or Firm*—Kubotera & Associates, LLC

(57) ABSTRACT

A printing apparatus prints on a medium at a first transport speed or a second transport speed lower than the first transport speed. The printing apparatus includes: an image forming unit for forming a developer image on the medium according to a print job sent from a host device; a fixing unit for fixing the developer image on the medium; a discharge roller for discharging the medium; a discharged medium detection unit for detecting a trailing edge of the medium passing through the fixing unit; a last medium determining unit for determining whether the discharged medium detection unit detects a last medium of the print job; and a control unit for discharging the medium at the first transport speed or controlling the last medium determining unit to determine the last medium and discharging the last medium at a transport speed higher than the second transport speed.

19 Claims, 10 Drawing Sheets

| Transport speed (mm/s) | Result |
|---|---|
| 80 | Poor |
| 90 | Poor |
| 100 | Good |
| 110 | Good |
| 120 | Good |

PRINTING APPARATUS

BACKGROUND OF THE INVENTION AND RELATED ART STATEMENT

The present invention relates to a printing apparatus.

In a conventional printing apparatus such as a printer and a copier, a sheet discharge unit is provided for discharging a sheet medium such as a printed sheet to outside the printing apparatus. The discharge unit is typically provided with a drive roller and a follower roller pressed against the drive roller. In the discharge unit, when a thin medium or a sheet with low stiffness is printed, it may be difficult to properly discharge such a medium, thereby causing discharge problem.

In order to solve the problem, Patent Reference has proposed a printing apparatus having a sheet discharge unit in which a plurality of bendable wings is disposed at both sides of follower rollers. In the sheet discharge unit, a plurality of follower rollers is separately urged and pressed against a drive roller from below. When the drive roller rotates, a sheet is sandwiched between the drive roller and the follower rollers to be transported. A plurality of elastic members rotating together with the follower rollers is disposed at both sides of the follower rollers. The elastic members have the bendable wings at circumferences thereof. When the bendable wings abut against circumferences of the follower rollers or the sheet, the bendable wings are capable of bending downward. The bendable wings are elastic members and capable of returning to original standing posture thereof. Patent Reference: Japanese Patent Publication No. 06-32511

As described above, in the sheet discharge unit of the conventional printing apparatus, the bendable wings are disposed at both sides of the follower rollers. Accordingly, the wings may cause damage on a medium. Also, the configuration tends to be complicated and increase cost. Further, the wings tend to wear, thereby reducing durability of the discharge unit.

When the follower rollers are not provided with the bendable wings, a medium is discharged only through a force with which the follower rollers are pressed against the drive roller. In this case, the medium is discharged with a relatively small force, thereby making it difficult to smoothly discharge the medium. Especially, in a case of a last medium printed as a last page of a print job, the last medium is not pushed with a subsequent sheet. Accordingly, it is difficult to smoothly discharge the last medium, and the last medium tends to remain on the follower roller or the drive roller.

In view of the problems described above, an object of the present invention is to provide a printing apparatus, in which it is possible to solve the problems in the conventional printer and improve image quality. In the printing apparatus, when it is detected that a last sheet of a print job passes through a fixing unit, it is possible to increase a transport speed of a discharge roller for discharging the medium, thereby increasing inertia of the last sheet. Accordingly, it is possible to securely discharge the last sheet without a complicated configuration and damage on the medium.

Further objects and advantages of the invention will be apparent from the following description of the invention.

SUMMARY OF THE INVENTION

In order to attain the objects described above, according to the present invention, a printing apparatus prints on a first medium at a first transport speed and on a second medium at a second transport speed lower than the first transport speed.

The printing apparatus comprises: an image forming unit for forming a developer image on the first and second media according to a print job sent from a host device or an upper device; a fixing unit for fixing the developer image on the first and second media; a discharge roller for discharging the first and second media with the developer image fixed thereon; a discharged medium detection unit disposed at a downstream side of the fixing unit for detecting a trailing edge of the first or second medium passing through the fixing unit; a last medium determining unit for determining whether the discharged medium detection unit detects a last medium of the print job; and a control unit for discharging the first medium at the first transport speed when the printed medium is the first medium, and for controlling the last medium determining unit to determine the last medium and discharging the last medium at a transport speed higher than the second transport speed when the printed medium is the second medium.

With the configuration described above, in the printing apparatus, when the last medium of the print job passes through the fixing unit, and the discharged medium detection unit detects the last medium of the print job, the discharge roller discharges the last medium at an increased speed. Accordingly, it is possible to increase inertia of the last medium and securely discharge the last medium without a complicated configuration and damage on the medium.

DETAILED DESCRIPTION OF PREFERRED EMBODIMENTS

Hereunder, embodiments of the present invention will be explained with reference to the accompanying drawings.

First Embodiment

Figure 1:
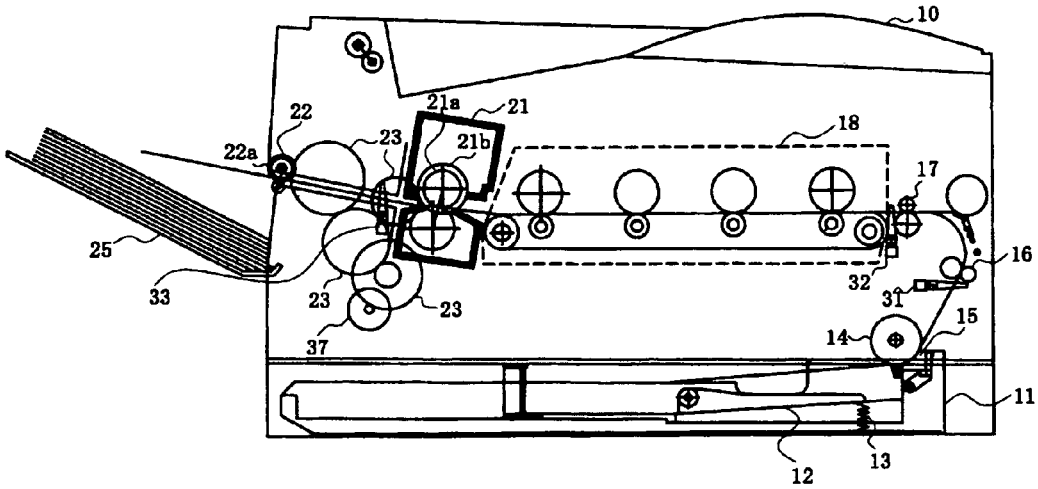
FIG. 1 is a schematic view showing a printing apparatus according to a first embodiment of the present invention.

FIG. 1 is a schematic view showing a printing apparatus 10 according to a first embodiment of the present invention. The printing apparatus 10 is connected to a host device or an upper device (not shown) for receiving print data sent from the upper device, thereby performing a printing operation. The printing apparatus 10 is an electro-photography type printing apparatus, and may include a monochrome printing apparatus and a color printing apparatus.

As shown in FIG. 1, the printing apparatus 10 is provided with a cassette or a medium storage unit 11 for storing media such as printing sheets therein in a stacked state. The cassette 11 includes a sheet plate or medium table 12, a spring 13 for moving the sheet plate 12, and a separation piece 15 for separating the medium one by one.

Further, the printing apparatus 10 is provided with a transport roller 14 for transporting the medium from the cassette 11. A drive shaft of the transport roller 14 is connected to a sheet supply motor 34 controlled by a control unit 30 (described later) through a gear (not shown). A resist roller 16 and a transport roller 17 having a mechanism for correcting skew of the medium are disposed in the printing apparatus 10 to constitute a part of a medium transport path. Drive shafts of the resist roller 16 and the transport roller 17 are connected to a resist motor 35 controlled by the control unit 30 (described later) through a gear (not shown).

Further, the printing apparatus 10 is provided with an image forming unit 18 for forming a toner image through an electro-photography method including a charging process, an exposure process, and a developing process, and for transferring the toner image to the medium, thereby forming an image on the medium. A drive shaft of the image forming unit 18 is connected to a belt motor 36 controlled by a control unit 30 (described later) through a gear (not shown).

Further, the printing apparatus 10 is provided with a fixing unit 21 for fixing the toner image transferred to the medium by the image forming unit 18 to the medium. A discharge roller 22 is disposed at a downstream side of the fixing unit 21 to form a medium discharge path for discharging the medium with the toner image fixed thereon. The fixing unit 21 includes a fixing roller 21*a* and a fixing gear 21*b*. The fixing roller 21*a* is driven by the fixing gear 21*b* coaxially connected thereto. The fixing gear 21*b* is connected to a fixing motor 37 through a plurality of gears 23. A discharge gear 22*a* is connected to a shaft of the discharge roller 22, and the discharge gear 22*a* is connected to the fixing motor 37 for driving the fixing unit 21 through the plurality of gears 23. That is, the fixing unit 21 and the discharge roller 22 have the common drive source.

Further, the printing apparatus 10 is provided with a stacker or stacking table 25 for stacking the printed medium after the toner image is transferred and the medium is discharged. The stacker 25 is attached to the printing apparatus 10 in a horizontal state or an upward state.

Figures 2, 3:
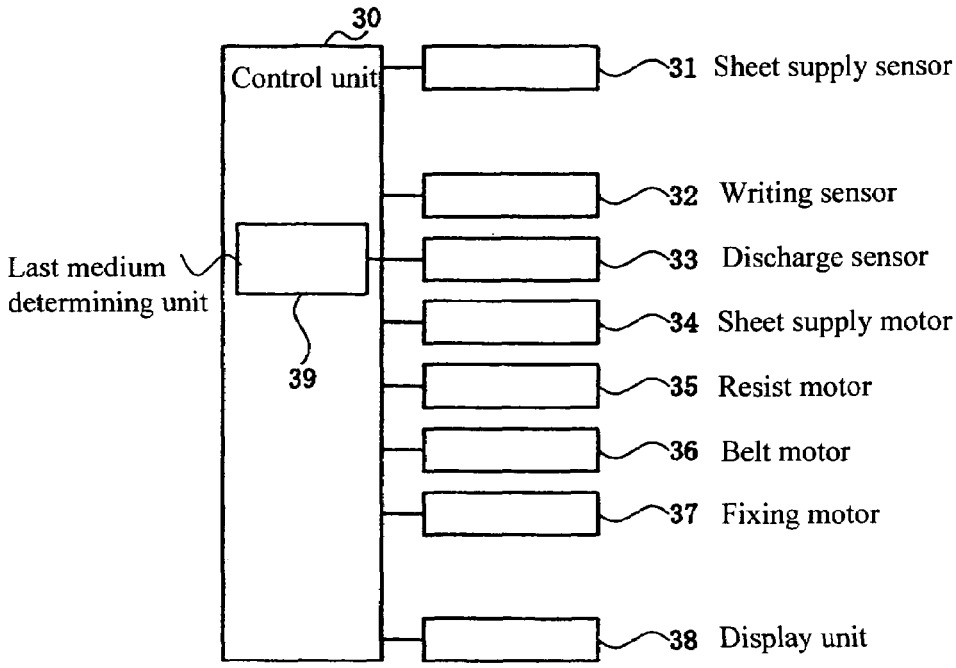
FIG. 2 is a block diagram showing a configuration of the printing apparatus according to the first embodiment of the present invention.
FIG. 3 is a table showing experimental results of a transport speed of a discharge roller according to the first embodiment of the present invention.

A configuration of the printing apparatus 10 will be explained next. FIG. 2 is a block diagram showing a configuration of the printing apparatus according to the first embodiment of the present invention.

As shown in FIG. 2, the printing apparatus 10 is provided with the control unit 30; a sheet supply sensor 31; a writing sensor 32; a discharge sensor or a discharged medium detection unit 33 for detecting the medium passing through the fixing unit 21; the sheet supply motor 34; the resist motor 35; the belt motor 36; the fixing motor 37; and a display unit 38.

In the medium transport path, as shown in FIG. 1, the sheet supply sensor 31 is disposed between the transport roller 14 and the resist roller 16; the writing sensor 32 is disposed between the transport roller 17 and the image forming unit 18; and the discharged medium detection unit 33 is disposed between the fixing unit 21 and the discharge roller 22. In the embodiment, the sheet supply sensor 31, the writing sensor 32, the discharged medium detection unit 33, the sheet supply motor 34, the resist motor 35, the belt motor 36, the fixing motor 37, and the display unit 38 are connected to the control unit 30, respectively, so that the control unit 30 controls the same.

The control unit 30 analyzes a print job received from the upper device (not shown), and sorts out the print data per page to form image data. The control unit 30 includes a last medium determining unit 39. The last medium determining unit 39 counts a medium detection signal sent from the discharged medium detection unit 33, and then compares a count value with a page number of the image data processed at the control unit 30, so that the last medium determining unit 39 determines whether the medium with a last page of the image data printed thereon, i.e., a last medium of the print job, is detected. Instead of the discharged medium detection unit 33, it is possible to use the writing sensor 32 for detecting the last medium of the print job.

Figure 4:
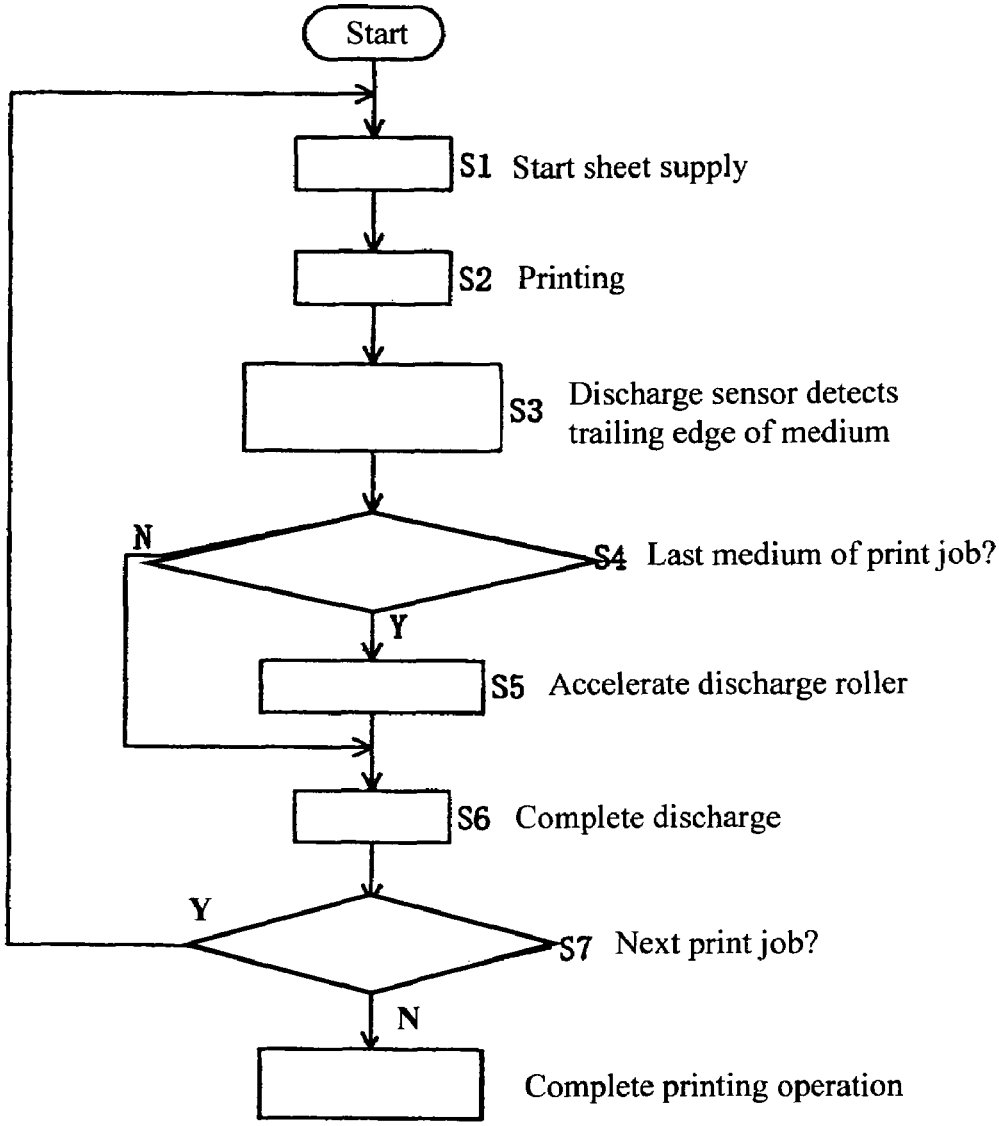
FIG. 4 is a flow chart showing an operation of the printing apparatus according to the first embodiment of the present invention.

An operation of the printing apparatus 10 will be explained next. FIG. 3 is a table showing experimental results of a transport speed of the discharge roller according to the first embodiment of the present invention. FIG. 4 is a flow chart showing an operation of the printing apparatus according to the first embodiment of the present invention.

In the printing apparatus 10 having a transport speed of the medium at a low setting, for example, 80 mm/s, when the upper device sends a print command to the printing apparatus 10, the spring 13 lifts the sheet plate 12 disposed inside the printing apparatus 10 and having the media stacked therein to a position where the transport roller 14 is pressed against an upper surface of the medium stacked in the sheet plate 12.

With a sheet supply start signal, the drive mechanism such as the sheet supply motor 34 and the gears drive the transport roller 14 to rotate counter-clockwise in FIG. 1, thereby starting sheet supply. Accordingly, the transport roller 14 transports the uppermost medium stacked in the sheet plate 12 to the right direction in FIG. 1 through friction therebetween. When the transport roller 14 transports more than two media, the separation piece 15 prevents the second and subsequent media from being picked up through friction therebetween. Accordingly, it is possible to transport the medium one by one. After the transport roller 14 picks up the medium from the cassette 11, the medium is transported to the resist roller 16 along the medium transport path. Then, the resist roller 16 corrects skew of the medium, and the medium is transported to the image forming unit 18 through the transport roller 17.

According to the image data, a toner image is formed on the medium in the image forming unit 18. When the medium passes through the fixing unit 21, the toner image is fixed to the medium, thereby printing on the medium. After the medium is printed, the discharge roller 22 transports the medium, and the discharged medium detection unit 33 disposed between the fixing unit 21 and the discharge roller 22 detects a trailing edge of the medium. Then, the last medium determining unit 39 of the control unit 30 determines whether the detected medium is the last medium of the print job. When the medium is not the last medium of the print job, the medium is transported at the current speed, in this case, 80 mm/s, and discharged to the stacker 25. When the medium is the last medium of the print job, the printing apparatus 10 controls the discharge roller 22 to accelerate to a specific transport speed, so that the medium is transported at the increased speed and discharged to the stacker 25. In the embodiment, it is preferred that the transport speed of the discharge roller 22 is accelerated to a speed higher than 110 mm/s according to the following experiment.

FIG. 3 is a table showing experimental results of a relationship between a discharge state of the last medium and the transport speed of the discharge roller 22. In the experiment, a print job consisted of one page was repeated hundred times. The result is assessed as poor when more than one medium was not properly discharged. The result is assessed as good when all of the media were properly discharged. As shown in FIG. 3, it is found that the medium was properly discharged when the transport speed was higher than 100 mm/s. Considering a transport variance associated with various types of media, it is preferred that the transport speed of the discharge roller 22 is set higher than 110 mm/s.

In the first embodiment, the printing apparatus 10 determines whether there is a next print job. When there is the next print job, the medium is supplied again. When there is not the next print job, the process is completed.

A flow chart shown in FIG. 4 will be explained next. In step S1, the supply of the medium is started. In step S2, the medium is printed. In step S3, the discharged medium detection unit 33 detects the trailing edge of the medium. In step S4, it is determined whether the medium is the last medium of the print job. When the medium is the last medium of the print job, the process proceeds to step S5. When the medium is not the last medium of the print job, the process proceeds to step S6. In step S5, the transport speed of the discharge roller 22 is increased. In step S6, the discharge is completed. In step S7, it is determined whether there is a next print job. When there is the next print job, the process returns to step S1. When there is not the next print job, the process is completed.

As described above, in the first embodiment, when the last medium of the print job passes through the fixing unit 21 and the discharged medium detection unit 33 detects the trailing edge of the last medium, the transport speed of the discharge roller 22 is increased, thereby discharging the medium at the increased speed. Accordingly, it is possible to increase inertia of the last medium and securely discharge the last medium without leaving the last medium on the discharge roller 22. It is not necessary to provide the discharge roller 22 with a special configuration, for example, a protrusion such as a wing, thereby making the configuration of the discharge roller 22 simple. Further, it is possible to prevent the medium from being damaged or scratched. Also, the fixing unit 21 and the discharge roller 22 have the common drive source, thereby efficiently discharging the medium.

Second Embodiment

A second embodiment of the present invention will be explained next. Components similar to those in the first embodiment are designated by the same reference numerals, and explanations thereof are omitted. Further, explanations of operations and effects similar to those in the first embodiment are omitted as well.

Figure 5:
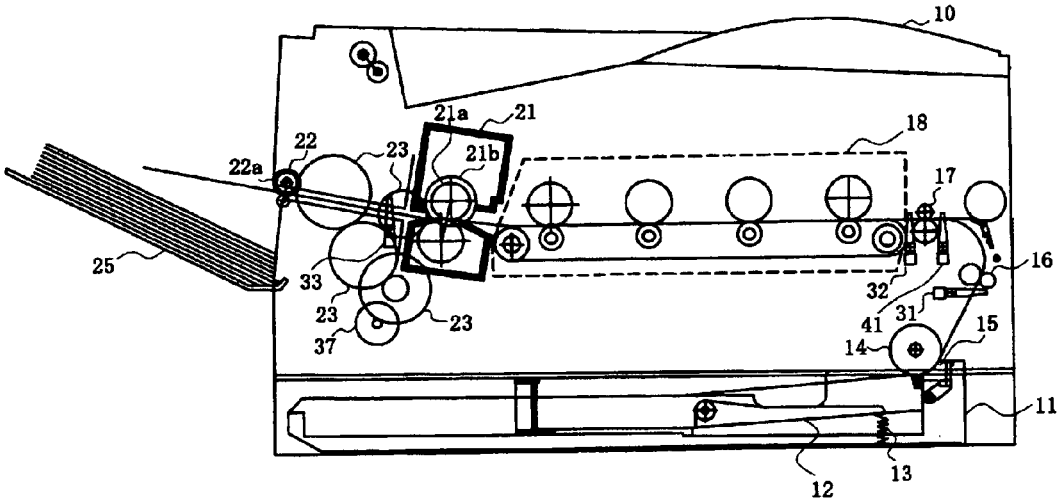
FIG. 5 is a schematic view showing a printing apparatus according to a second embodiment of the present invention.
Figure 6:
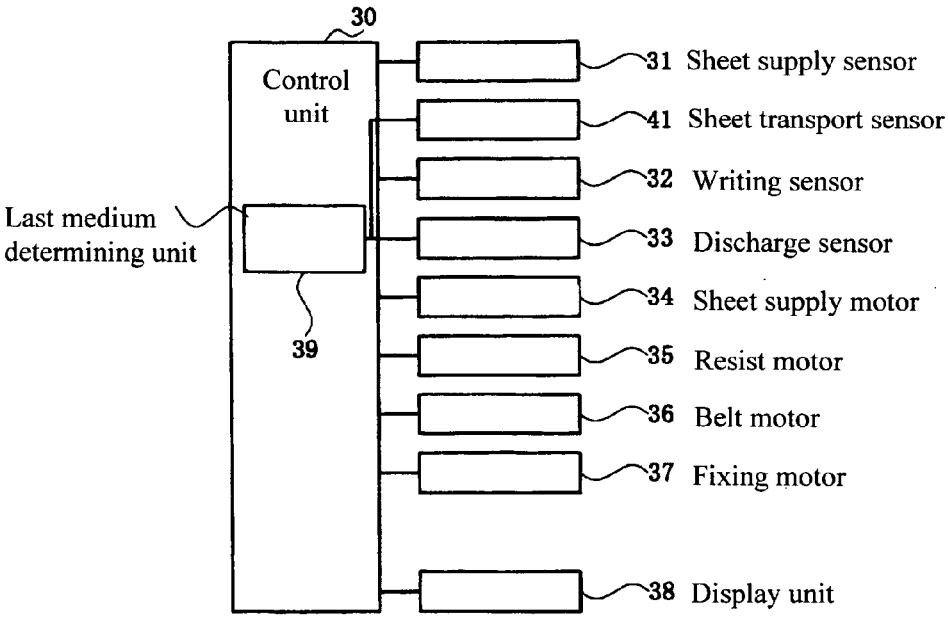
FIG. 6 is a block diagram showing a configuration of the printing apparatus according to the second embodiment of the present invention.

FIG. 5 is a schematic view showing a printing apparatus according to a second embodiment of the present invention. FIG. 6 is a block diagram showing a configuration of the printing apparatus according to the second embodiment of the present invention.

As shown in FIG. 5, in the second embodiment, a sheet transport sensor or a transported medium detection unit 41 is disposed at an upstream side of the image forming unit 18 between the resist roller 16 and the transport roller 17 for detecting the medium transported into the image forming unit 18. As shown in FIG. 6, the sheet transport sensor 41 is connected to the control unit 30 and controlled by the same.

In the embodiment, the last medium determining unit 39 receives medium signals from the discharged medium detection unit 33 and the sheet transport sensor 41. When the discharged medium detection unit 33 detects the medium and the sheet transport sensor 41 does not detect a subsequent medium, the last medium determining unit 39 determines that the last medium is detected. Other configuration is the same as that in the first embodiment, and explanation thereof is omitted.

Figure 7:
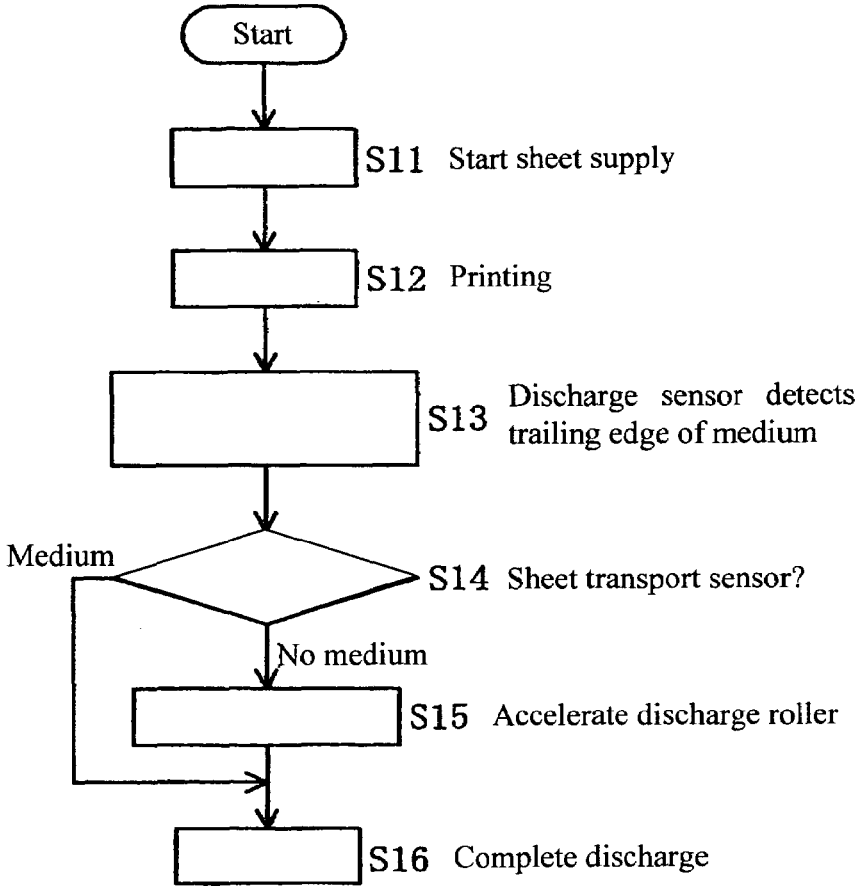
FIG. 7 is a flow chart showing an operation of the printing apparatus according to the second embodiment of the present invention.

An operation of the printing apparatus 10 of the second embodiment will be explained next. FIG. 7 is a flow chart showing an operation of the printing apparatus 10 according to the second embodiment of the present invention. In the second embodiment, a process from supplying the medium from the cassette 11 to detecting the trailing edge of the medium with the discharged medium detection unit 33 is the same as that in the first embodiment, and explanation thereof is omitted.

When the discharged medium detection unit 33 detects the trailing edge of the medium, the sheet transport sensor 41 determines whether there is a subsequent medium. When the sheet transport sensor 41 detects the subsequent medium, the medium is transported at the current speed, in this case, 80 mm/s, and discharged to the stacker 25. When the sheet transport sensor 41 does not detect the subsequent medium, it is determined that the discharged medium detection unit 33 detects the trailing edge of the last medium. Accordingly, the printing apparatus 10 controls the discharge roller 22 to accelerate to a specific transport speed, so that the medium is transported at the increased speed and discharged to the stacker 25. In the second embodiment, similar to the first embodiment, it is preferred that the transport speed of the discharge roller 22 is accelerated to a speed higher than 110 mm/s.

In the first embodiment, the last medium determining unit 39 counts the number of pages of the image data in the print job and medium detection signals sent from the discharged medium detection unit 33, and then compares the count value of the signals with the number of pages of the image data, so that the last medium determining unit 39 determines whether the last medium is detected. Accordingly, when the last page of the image data in one print job is printed on the medium, the medium is certainly determined to be the last medium, thereby accelerating the speed of the discharge roller 22. As described above, the discharge roller 22 and the fixing roller 21*a* have the common drive source, i.e., the fixing motor 37. Accordingly, when the rotational speed of the discharge roller 22 is increased, the rotational speed of the fixing roller 21*a* is increased.

When the print job is sequentially sent from the upper device and the printing operation is continuously performed, the first medium of one print job is continuously transported right after the last medium of another print job. In this case, the last medium of another print job may be discharged at the same time that the first medium of one print job is fixed. When the rotational speed of the fixing roller 21*a* changes while the medium is fixed, heat per unit time supplied to the medium may change, thereby changing fixing condition.

Accordingly, in the first embodiment, when the print job is sequentially sent from the upper device, it is necessary to provide a certain interval between the print jobs for adjusting the transport speed of the fixing roller 21*a*, thereby making a total process time longer. On the other hand, in the second embodiment, according to the detection signals from the physical detection means, i.e., the discharged medium detection unit 33 and the sheet transport sensor 41, it is determined that the medium transported last after all print jobs are completed is the last medium. Accordingly, even when the print job is sequentially sent from the upper device, the transport speeds of the discharge roller 22 and the fixing roller 21*a* do not change between each print job. As a result, it is not necessary to provide a certain interval between the print jobs. That is, when a plurality of the print jobs is sequentially processed, it is possible to shorten the process time as opposed to the first embodiment.

The flow chart shown in FIG. 7 will be explained next. In step S11, the supply of the medium is started. In step S12, the medium is printed. In step S13, the discharged medium detection unit 33 detects the trailing edge of the medium. In step S14, it is determined whether the sheet transport sensor 41 detects the subsequent medium. When the sheet transport sensor 41 does not detect the subsequent medium, the process proceeds to step S15. When the sheet transport sensor 41 detects the subsequent medium, the process proceeds to step S16. In step S15, the transport speed of the discharge roller 22 is increased. In step S16, the discharge is completed, and the process is completed.

As described above, in the second embodiment, after the medium passes through the fixing unit 21, when the discharged medium detection unit 33 disposed at the downstream side of the fixing unit 21 detects the trailing edge of the medium, and the sheet transport sensor 41 disposed at the upstream side of the image forming unit 18 does not detect the subsequent medium, the transport speed of the discharge roller 22 increases to a specific speed to discharge the medium. Accordingly, in addition to the effects of the first embodiment, when a plurality of the print jobs is sequentially processed, it is not necessary to wait for the printing operation of the next print job, thereby shortening the process time as opposed to the first embodiment.

Third Embodiment

A third embodiment of the present invention will be explained next. Components similar to those in the first and second embodiments are designated by the same reference numerals, and explanations thereof are omitted. Further, explanations of operations and effects similar to those in the first and second embodiments are omitted as well.

In the third embodiment, the printing apparatus 10 has a configuration same as that shown in FIGS. 5 and 6. In the third embodiment, the control unit 30 has a function of recognizing a type of medium such as an envelope, an OHP (Over Head Projector), a film, and a postcard, and for controlling the transferring speed and the fixing speed according to the type of medium.

Figure 8:
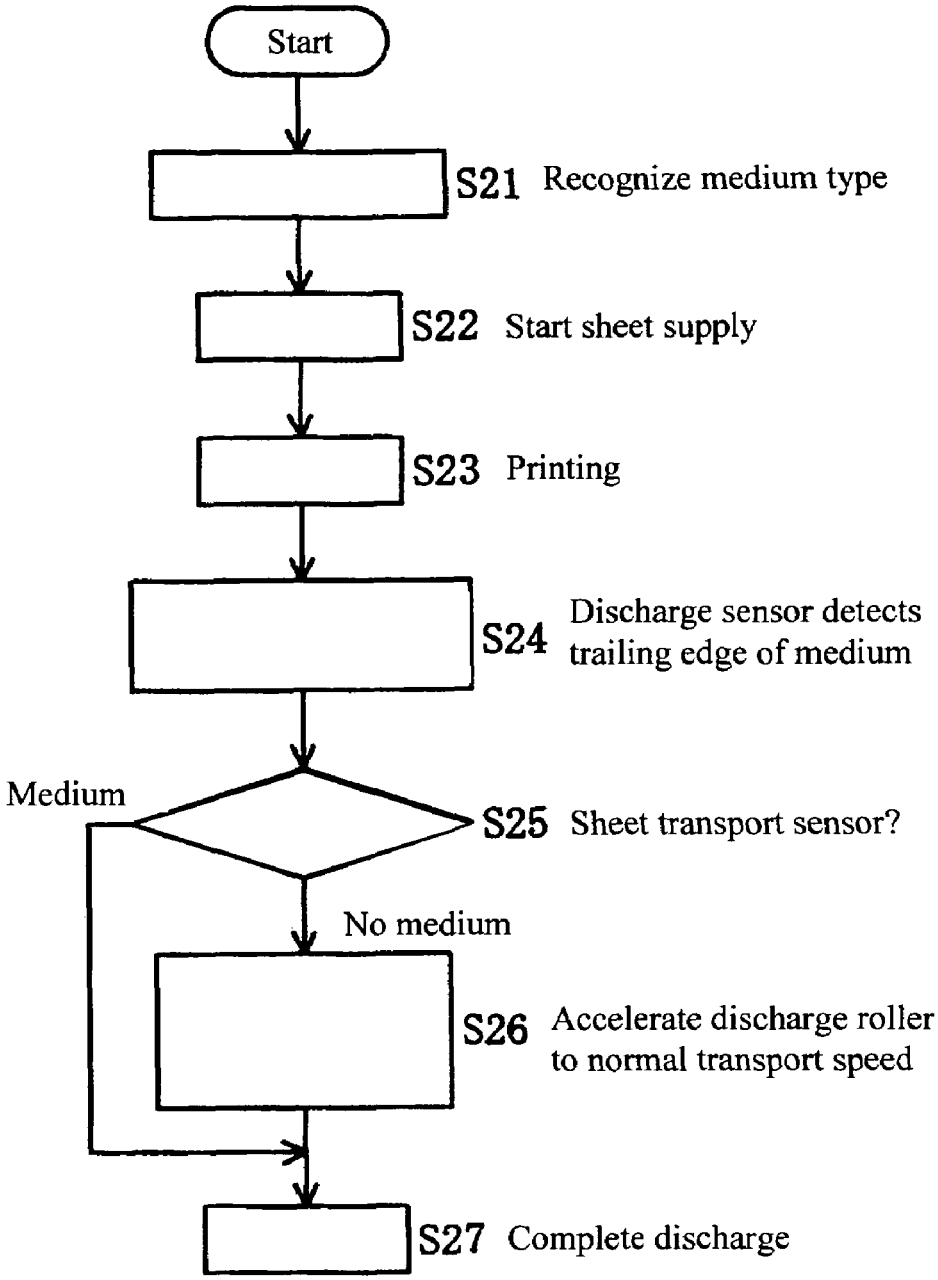
FIG. 8 is a flow chart showing an operation of the printing apparatus according to a third embodiment of the present invention.

An operation of the printing apparatus 10 of the third embodiment will be explained next. FIG. 8 is a flow chart showing an operation of the printing apparatus 10 according to the third embodiment of the present invention.

When the medium is a normal type, i.e., a standard sheet or a first medium, the transport speed of the printing apparatus 10 is set at a high speed higher than 100 mm/s, for example, 160 mm/s or a first transport speed. When the medium is a special type other than the normal type, it is necessary to decrease the transport speed lower than 100 mm/s due to the fixing performance. In this case, the medium tends to remain on the discharge roller 22, thereby causing discharge problem.

To this end, an operator operates the display unit 38 of the printing apparatus 10 or the personal computer as the upper device to select a type of medium, so that the control unit 30 recognizes the selected type of medium. When the type requiring a slower transport speed such as an envelope or a second medium is selected, the control unit 30 determines the fixing speed according to the selected medium, and sets the transport speed of the medium at, for example, 70 mm/s or a second transport speed according to the determined fixing speed.

A process from supplying the medium from the cassette 11 to detecting the trailing edge of the medium with the discharged medium detection unit 33 is the same as that in the second embodiment, and explanation thereof is omitted.

When the discharged medium detection unit 33 detects the trailing edge of the medium, the sheet transport sensor 41 determines whether there is the subsequent medium. When the sheet transport sensor 41 detects the subsequent medium, the medium is transported at the current speed, in this case, 70 mm/s, and discharged to the stacker 25. When the sheet transport sensor 41 does not detect the subsequent medium, it is determined that the discharged medium detection unit 33 detects the trailing edge of the last medium. Accordingly, the printing apparatus 10 controls the discharge roller 22 to accelerate (return) to the normal transport speed, for example, 160 mm/s, so that the medium is transported at the normal speed and discharged to the stacker 25.

The flow chart shown in FIG. 8 will be explained next. In step S21, the medium type is recognized. In step S22, the supply of the medium is started. In step S23, the medium is printed. In step S24, the discharged medium detection unit 33 detects the trailing edge of the medium. In step S25, it is determined whether the sheet transport sensor 41 detects the subsequent medium. When the sheet transport sensor 41 does not detect the subsequent medium, the process proceeds to step S26. When the sheet transport sensor 41 detects the subsequent medium, the process proceeds to step S27. In step S26, the transport speed of the discharge roller 22 is increased to the normal transport speed. In step S27, the discharge is completed, and the process is completed.

As described above, in the third embodiment, in the case that the medium needs to be fixed at a speed lower than the normal fixing speed (transport speed), after the medium passes through the fixing unit 21, when the discharged medium detection unit 33 disposed at the downstream side of the fixing unit 21 detects the trailing edge of the medium, and the sheet transport sensor 41 disposed at the upstream side of the image forming unit 18 does not detect the subsequent medium, the transport speed of the discharge roller 22 increases (returns) to the normal speed to discharge the medium. Accordingly, it is possible to securely discharge even the special medium.

Further, in the third embodiment, it is arranged such that just the speed of the discharge roller 22 returns to the normal speed. Accordingly, it is possible to simplify the control. Further, when the subsequent medium is the normal medium used at a high frequency, it is possible to shorten a start-up time for the printing operation.

Fourth Embodiment

Figure 9:
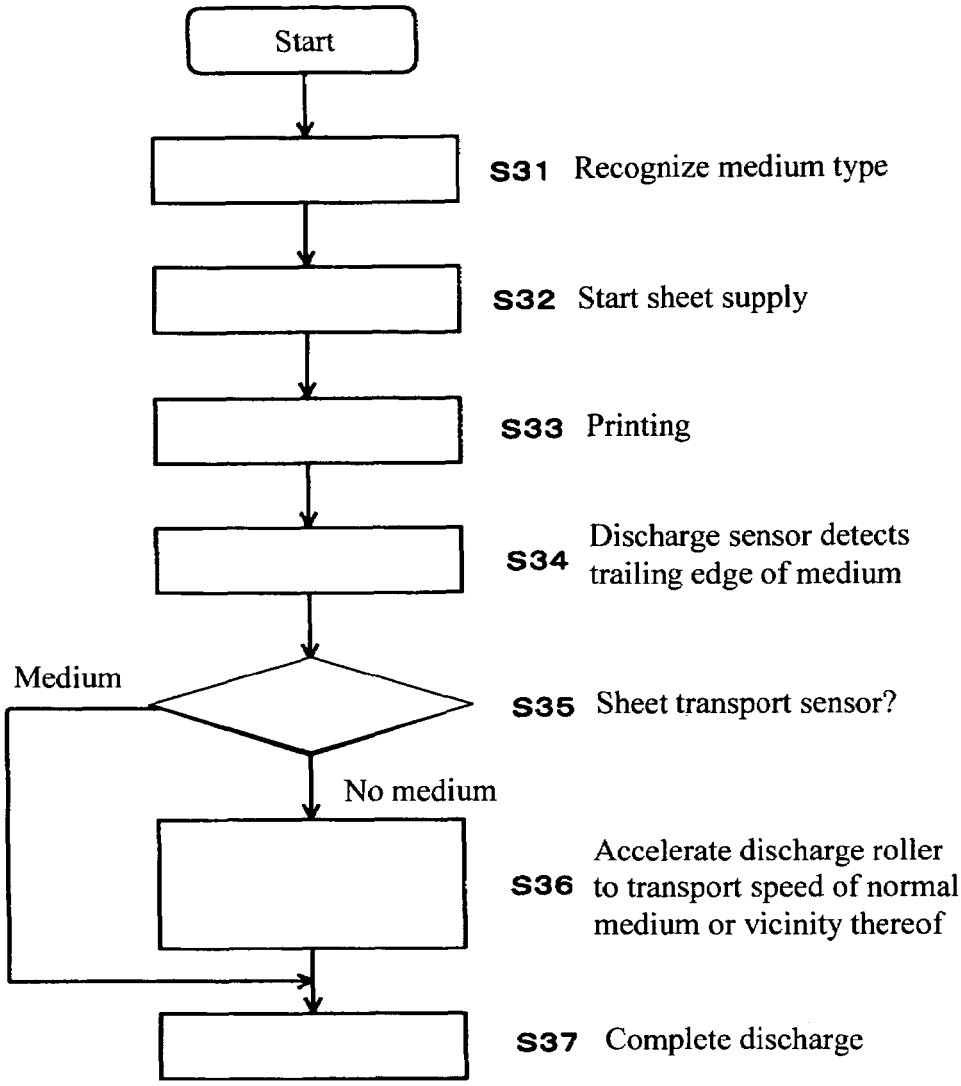
FIG. 9 is a flow chart showing an operation of the printing apparatus according to a fourth embodiment of the present invention.
Figure 10:
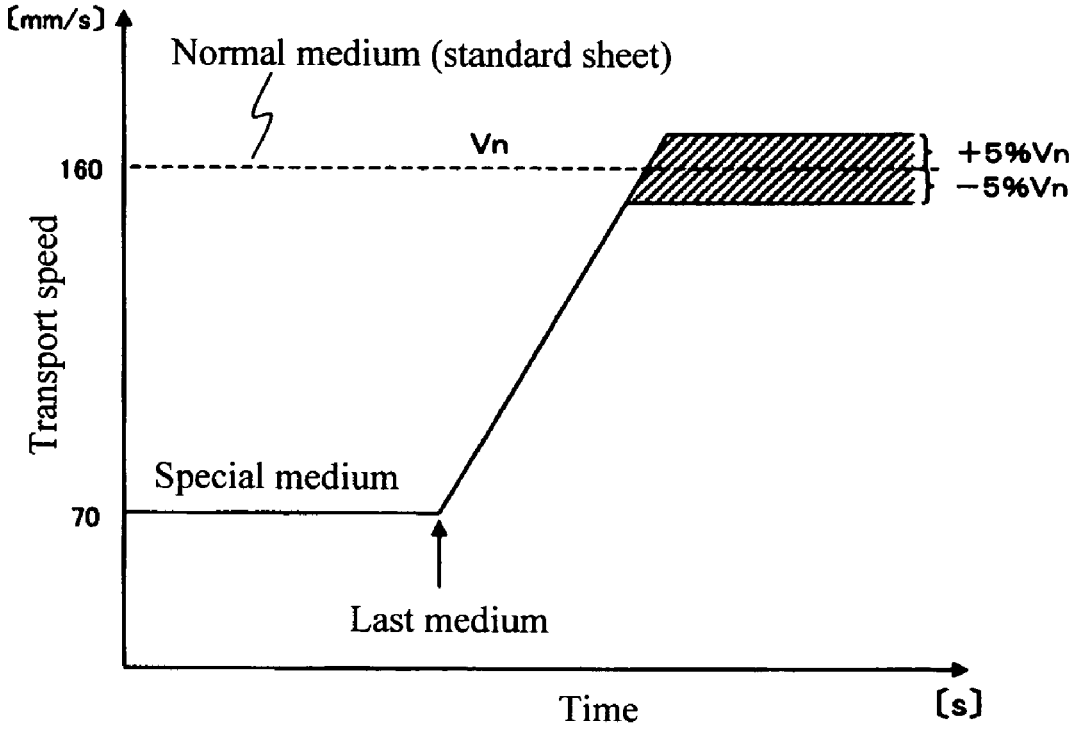
FIG. 10 is a graph showing a change in a transport speed according to the fourth embodiment of the present invention.

A fourth embodiment of the present invention will be explained next. FIG. 9 is a flow chart showing an operation of the printing apparatus according to the fourth embodiment of the present invention. FIG. 10 is a graph showing a change in a transport speed according to the fourth embodiment of the present invention.

As described above, when the medium is the normal type, i.e., the standard sheet (first medium), the transport speed of the printing apparatus 10 is set at a high speed higher than 100 mm/s, for example, 160 mm/s (first transport speed). When the medium is the special type other than the normal type, it is necessary to decrease the transport speed lower than 100 mm/s due to the fixing performance. In this case, the medium tends to remain on the discharge roller 22, thereby causing discharge problem.

To this end, an operator operates the display unit 38 of the printing apparatus 10 or the personal computer as the upper device to select a type of medium, so that the control unit 30 recognizes the selected type of medium. When the type requiring a slower transport speed such as an envelope (second medium) is selected, the control unit 30 determines the fixing speed according to the selected medium, and sets the transport speed of the medium at, for example, 70 mm/s (second transport speed) according to the determined fixing speed.

A process from supplying the medium from the cassette 11 to detecting the trailing edge of the medium with the discharged medium detection unit 33 is the same as that in the second embodiment, and explanation thereof is omitted.

When the discharged medium detection unit 33 detects the trailing edge of the medium, the sheet transport sensor 41 determines whether there is the subsequent medium. When the sheet transport sensor 41 detects the subsequent medium, the medium is transported at the current speed, in this case, 70 mm/s, and discharged to the stacker 25. When the sheet transport sensor 41 does not detect the subsequent medium, it is determined that the discharged medium detection unit 33 detects the trailing edge of the last medium. At this time, the printing apparatus 10 accelerates the transport speed of the discharge roller 22 to Vn or a vicinity of Vn as indicated by a hatched area in FIG. 10, where Vn is the normal transport speed (first transport speed). Then, the detected medium is transported and discharged to the stacker 25.

In the embodiment, the transport speed at the vicinity of Vn may include, for example, a speed in a range of plus/minus 5% of Vn for the following reason. As described above, the discharge roller 22 and the fixing roller 21*a* have the common drive source, i.e., the fixing motor 37. Accordingly, when the speed of the discharge roller 22 changes, the speed of the fixing roller 21*a* changes. When the speed of the fixing roller 21*a* changes, heat per unit time supplied to the medium changes, thereby changing the fixing condition and causing variance in print quality.

In order to prevent the variance in print quality, it has been empirically found that it is necessary to maintain a surface temperature of the medium within plus/minus 2° C. under a normal environmental condition of the printing apparatus such as an environmental temperature between 10° C. and 40° C. To this end, it is necessary to maintain a variance in the transport speed of the discharge roller 22 and the fixing roller 21*a* within plus/minus 8 mm/s. Accordingly, when the transport speed of the normal medium Vn is 160 mm/s, the allowable range of the transport speed is Vn plus/minus 8 mm/s, that is, Vn plus/minus 5% of Vn mm/s.

When the printing apparatus is used under more harsh condition such as an environmental temperature below 10° C. or above 40° C., it is necessary to maintain the transport speed of the discharge roller 22 and the fixing roller 21*a* within an allowable range of Vn plus/minus 5 mm/s, that is Vn plus/minus 3% of Vn mm/s. In other words, when the transport speed of the last medium is maintained within the range of Vn plus/minus 5% of Vn, in the case that the subsequent print job uses the normal medium, it is possible to flexibly set the speed in consideration of the variance of the transport speed while maintaining good print quality.

The flow chart shown in FIG. 9 will be explained next. In step S31, the medium type is recognized. In step S32, the supply of the medium is started. In step S33, the medium is printed. In step S34, the discharged medium detection unit 33 detects the trailing edge of the medium. In step S35, it is determined whether the sheet transport sensor 41 detects the subsequent medium. When the sheet transport sensor 41 does not detect the subsequent medium, the process proceeds to step S36. When the sheet transport sensor 41 detects the subsequent medium, the process proceeds to step S37. In step S36, the transport speed of the discharge roller 22 is increased to the transport speed of the normal medium or standard sheet, or the vicinity of the transport speed of the normal medium. In step S37, the discharge is completed, and the process is completed.

As described above, in the fourth embodiment, in the case that the medium is the special medium such as an envelope required to be fixed at a speed lower than the normal fixing speed (transport speed), after the medium passes through the fixing unit 21, when the sheet transport sensor 41 disposed at the upstream side of the fixing unit 21 does not detect the subsequent medium, the transport speed of the discharge roller 22 increases to the transport speed of the normal medium or the vicinity thereof to discharge the medium. Accordingly, in addition to the effects in the third embodiment, when the subsequent job includes the normal medium or the standard sheet used at a high frequency, it is possible to flexibly set the speed considering the variance in the transport speed.

Fifth Embodiment

A fifth embodiment of the present invention will be explained next. Components similar to those in the first to fourth embodiments are designated by the same reference numerals, and explanations thereof are omitted. Further, explanations of operations and effects similar to those in the first to fourth embodiments are omitted as well.

In the fifth embodiment, the printing apparatus 10 has a configuration same as that shown in FIGS. 5 and 6. In the fifth embodiment, similar to the third embodiment, the control unit 30 has the function of recognizing a type of medium such as an envelope, an OHP, a film, and a postcard, and for controlling the transferring speed and the fixing speed according to the type of medium.

Figure 11:
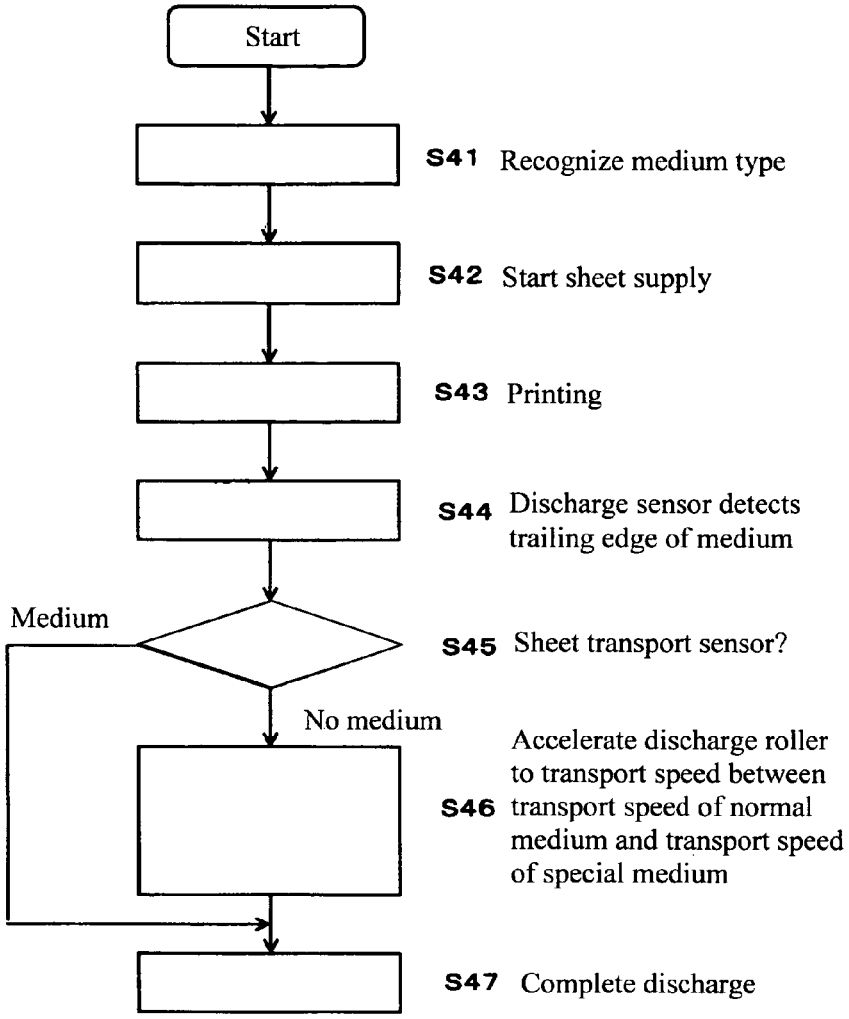
FIG. 11 is a flow chart showing an operation of the printing apparatus according to a fifth embodiment of the present invention.
Figure 12:
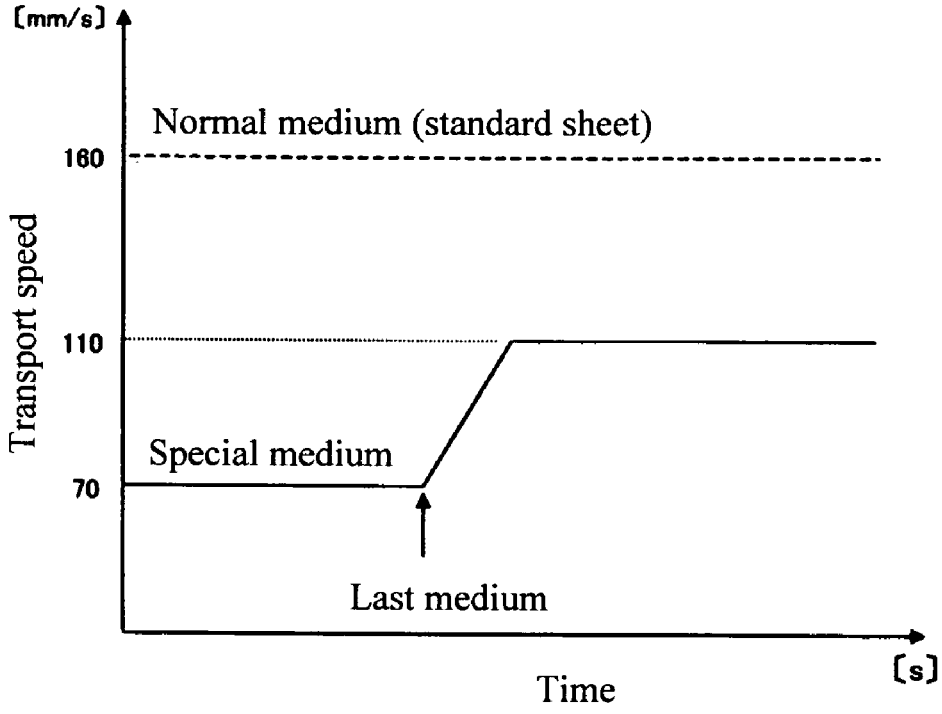
FIG. 12 is a graph showing a change in a transport speed according to the fifth embodiment of the present invention.

An operation of the printing apparatus 10 of the fifth embodiment will be explained next. FIG. 11 is a flow chart showing the operation of the printing apparatus 10 according to the fifth embodiment of the present invention. FIG. 12 is a graph showing a change in the transport speed according to the fifth embodiment of the present invention.

When the medium is the normal type, i.e., the standard sheet (first medium), the transport speed of the printing apparatus 10 is set at a high speed higher than 100 mm/s, for example, 160 mm/s (first transport speed). When the medium is the special type other than the normal type, it is necessary to decrease the transport speed lower than 100 mm/s due to the fixing performance. In this case, the medium tends to remain on the discharge roller 22, thereby causing discharge problem.

To this end, an operator operates the display unit 38 of the printing apparatus 10 or the personal computer as the upper device to select a type of medium, so that the control unit 30 recognizes the selected type of medium. When the type requiring a slower transport speed such as an envelope (second medium) is selected, the control unit 30 determines the fixing speed according to the selected medium, and sets the transport speed of the medium at, for example, 70 mm/s (second transport speed) according to the determined fixing speed.

A process from supplying the medium from the cassette 11 to detecting the trailing edge of the medium with the discharged medium detection unit 33 is the same as that in the second embodiment, and explanation thereof is omitted.

When the discharged medium detection unit 33 detects the trailing edge of the medium, the sheet transport sensor 41 determines whether there is the subsequent medium. When the sheet transport sensor 41 detects the subsequent medium, the medium is transported at the current speed, in this case, 70 mm/s, and discharged to the stacker 25. When the sheet transport sensor 41 does not detect the subsequent medium, it is determined that the discharged medium detection unit 33 detects the trailing edge of the last medium. At this time, as shown in FIG. 12, the printing apparatus 10 controls the discharge roller 22 to accelerate to a transport speed (third transport speed), for example, 110 mm/s, between the transport speed (first transport speed) of the normal medium (first medium) and the transport speed (second transport speed) of the special medium (second medium), so that the medium is transported at the third transport speed and discharged to the stacker 25.

The flow chart shown in FIG. 11 will be explained next. In step S41, the medium type is recognized. In step S42, the supply of the medium is started. In step S43, the medium is printed. In step S44, the discharged medium detection unit 33 detects the trailing edge of the medium. In step S45, it is determined whether the sheet transport sensor 41 detects the subsequent medium. When the sheet transport sensor 41 does not detect the subsequent medium, the process proceeds to step S46. When the sheet transport sensor 41 detects the subsequent medium, the process proceeds to step S47. In step S46, the transport speed of the discharge roller 22 is increased to the transport speed between the transport speed of the normal medium and the transport speed of the special medium. In step S47, the discharge is completed, and the process is completed.

As described above, in the fifth embodiment, in the case that the medium is the special medium such as an envelope required to be fixed at a speed lower than the normal fixing speed (transport speed), after the medium passes through the fixing unit 21, when the discharged medium detection unit 33 disposed at the downstream side of the fixing unit 21 detects the trailing edge of the medium, and the sheet transport sensor 41 disposed at the upstream side of the image forming unit 18 does not detect the subsequent medium, the transport speed of the discharge roller 22 increases to the transport speed between the transport speed of the normal medium and the transport speed of the special medium. Accordingly, in addition to the effects in the third embodiment, when the subsequent job includes the normal medium (standard sheet) or the special medium (envelope, OHP, film, postcard, etc.), it is possible to shorten the start-up time for the printing operation.

In the first to fifth embodiments described above, the image forming apparatus is the printer as an example. The present invention is applicable to a copier, a printer, and a MFP (multi-function printer).

The present invention is not limited to the embodiments described above. For example, in the third to fifth embodiments, similar to the second embodiment, the discharge sensor 33 and the transported medium detection unit 41 are used for determining the timing when the transport speed of the discharge roller 22 is increased. Alternatively, similar to the first embodiment, it may be possible to determine the timing when the transport speed of the discharge roller 22 is increased according to the page number of the image data and the count value of the detection signals from the discharge sensor 33.

The disclosure of Japanese Patent Application No. 2005-273878, filed on Sep. 21, 2005, is incorporated in the application.

While the invention has been explained with reference to the specific embodiments of the invention, the explanation is illustrative and the invention is limited only by the appended claims.

What is claimed is:

1. A printing apparatus for printing on a first medium at a first transport speed and on a second medium at a second transport speed lower than the first transport speed, comprising:

an image forming unit for forming a developer image on one of the first medium and the second medium according to a print job sent from a host device;

a fixing unit for fixing the developer image on the one of the first medium and the second medium;

a discharge roller for discharging the one of the first medium and the second medium with the developer image fixed thereon;

a transported medium detection unit disposed at an upstream side of the fixing unit for detecting the one of the first medium and the second medium transported to the fixing unit;

a discharged medium detection unit disposed at a downstream side of the fixing unit for detecting a trailing edge of the one of the first medium and the second medium passing through the fixing unit;

a last medium determining unit connected to the transported medium detection unit and the discharged medium detection unit for determining that the one of the first medium and the second medium is a last medium when the discharged medium detection unit detects the trailing edge and the transported medium detection unit does not detect any of the first medium and the second medium; and a control unit for discharging the first medium at the first transport speed when the image forming unit forms the developer image on the first medium, and for controlling the last medium determining unit to determine the last medium and discharging the last medium at a transport speed higher than the second transport speed when the image forming unit forms the developer image on the second medium.

2. The printing apparatus according to claim 1, wherein said control unit discharges the last medium at one of the first transport speed and a substantially same speed as the first transport speed.

3. The printing apparatus according to claim 1, wherein said control unit discharges the last medium at a third transport speed between the first transport speed and the second transport speed.

4. The printing apparatus according to claim 1, wherein said transported medium detection unit is disposed at an upstream side of the image forming unit.

5. The printing apparatus according to claim 1, further comprising a drive source for driving both of the fixing unit and the discharge roller.

6. The printing apparatus according to claim 1, wherein said fixing unit is disposed at a downstream side of the image forming unit.

7. The printing apparatus according to claim 1, wherein said fixing unit is disposed at a downstream side of the image forming unit and said transported medium detection unit is disposed an upstream side of the image forming unit.

8. The printing apparatus according to claim 1, wherein said image forming unit is adopted to form the developer image on the first medium more frequently than the second medium.

9. The printing apparatus according to claim 1, wherein said image forming unit is adopted to form the developer image on the second medium including an envelope.

10. The printing apparatus according to claim 1, wherein said control unit is adopted to discharge the first medium at the first transport speed greater than 100 mm/sec, said second transport speed being smaller than 100 mm/sec.

11. The printing apparatus according to claim 1, wherein said control unit is adopted to discharge the first medium at the first transport speed greater than twice the second transport speed and smaller than thrice the second transport speed.

12. The printing apparatus according to claim 1, further comprising a drive source for driving both of the fixing unit and the discharge roller.

13. The printing apparatus according to claim 2, wherein said fixing unit is disposed at a downstream side of the image forming unit.

14. The printing apparatus according to claim 2, wherein said fixing unit is disposed at a downstream side of the image forming unit and said transported medium detection unit is disposed an upstream side of the image forming unit.

15. The printing apparatus according to claim 2, wherein said image forming unit is adopted to form the developer image on the first medium more frequently than the second medium.

16. The printing apparatus according to claim 2, wherein said image forming unit is adopted to form the developer image on the second medium including an envelope.

17. The printing apparatus according to claim 2, wherein said control unit is adopted to discharge the first medium at the first transport speed greater than 100 mm/sec, said second transport speed being smaller than 100 mm/sec.

18. The printing apparatus according to claim 2, wherein said control unit is adopted to discharge the first medium at the first transport speed greater than twice the second transport speed and smaller than thrice the second transport speed.

19. The printing apparatus according to claim 2, further comprising a drive source for driving both of the fixing unit and the discharge roller.

* * * * *